US011428062B2

(12) United States Patent
Hansen et al.

(10) Patent No.: US 11,428,062 B2
(45) Date of Patent: Aug. 30, 2022

(54) METHOD FOR MODIFYING INSTALLED WELLBORE FLOW CONTROL DEVICES

(71) Applicant: Aarbakke Innovation, AS, Bryne (NO)

(72) Inventors: Henning Hansen, Sirevåg (NO); Tarald Gudmestad, Nærbø (NO)

(73) Assignee: Aarbakke Innovation, AS, Bryne (NO)

( * ) Notice: Subject to any disclaimer, the term of this patent is extended or adjusted under 35 U.S.C. 154(b) by 57 days.

(21) Appl. No.: 17/093,198

(22) Filed: Nov. 9, 2020

(65) Prior Publication Data

US 2021/0054709 A1 Feb. 25, 2021

Related U.S. Application Data

(63) Continuation of application No. PCT/IB2019/054115, filed on May 18, 2019.

(60) Provisional application No. 62/676,303, filed on May 25, 2018.

(51) Int. Cl.
*E21B 29/08* (2006.01)
*E21B 34/06* (2006.01)

(52) U.S. Cl.
CPC ..... *E21B 29/08* (2013.01); *E21B 34/06* (2013.01)

(58) Field of Classification Search
CPC ..... E21B 29/08; E21B 43/12; E21B 34/08
See application file for complete search history.

(56) References Cited

U.S. PATENT DOCUMENTS

| | | | | |
|---|---|---|---|---|
| 2,526,695 | A | 10/1950 | Schlumberger | |
| 2009/0288833 | A1* | 11/2009 | Graham | E21B 43/26 175/78 |
| 2010/0101802 | A1* | 4/2010 | Hallundbaek | E21B 10/26 175/58 |
| 2013/0233555 | A1* | 9/2013 | Hallundb.ae butted.k | E21B 34/06 166/55 |
| 2014/0374100 | A1* | 12/2014 | Hallundbaek | E21B 29/08 166/386 |
| 2017/0030157 | A1* | 2/2017 | Hansen | E21B 43/12 |

FOREIGN PATENT DOCUMENTS

| | | | |
|---|---|---|---|
| CN | 103228863 | A | 7/2013 |
| WO | 2015/175025 | A1 | 11/2015 |
| WO | 2017/211361 | A1 | 12/2017 |

OTHER PUBLICATIONS

Canadian Office Action dated Nov. 23, 2021, for related Canadian Patent Application No. 3,097,675.
International Search Report, International Application No. PCT/IB2019/054115 dated Dec. 27, 2019.
Written Opinion of the International Search Authority, International Application No. PCT/IB2019/054115 dated Dec. 27, 2019.
Examination Report dated Jun. 4, 2021, for related Australian Patent Application No. 2019274220.

(Continued)

*Primary Examiner* — David Carroll
(74) *Attorney, Agent, or Firm* — Richard A. Fagin

(57) ABSTRACT

A method for modifying an element on a section of wellbore tubular includes positioning a wellbore intervention tool at a first location on the tubular, operating a penetration device to remove the element and create an orifice on the section of wellbore tubular, and operating an installation device to install a replacement element in the orifice.

17 Claims, 5 Drawing Sheets

(56) References Cited

OTHER PUBLICATIONS

Chinese Office Action dated Jun. 1, 2022, for Chinese Application No. 201980033637.1.
Translation of the first two pages of Chinese Office Action dated Jun. 1, 2022, for Chinese Application No. 201980033637.1.

* cited by examiner

METHOD FOR MODIFYING INSTALLED WELLBORE FLOW CONTROL DEVICES

CROSS REFERENCE TO RELATED APPLICATIONS

Continuation of International Application No. PCT/IB2019/054115 filed on May 18, 2019. Priority is claimed from U.S. Provisional Application No. 62/676,303 filed on May 25, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

BACKGROUND

The present disclosure relates generally to the field of flow restriction devices located in a wellbore. More specifically, this disclosure relates to a method for modifying elements of flow restriction devices by wellbore intervention.

Flow restriction devices, which may include inflow control devices (ICDs), autonomous inflow control devices (AICDs), inflow control valves (ICVs) and choke devices, are commonly used in the oil and gas industry to regulate, control or restrict the amount of fluids, including hydrocarbons, water and gas that may flow into wellbore tubulars such as conduits, pipes, liners or casing. In particular, flow restriction devices may be used to optimize hydrocarbon production rates, reduce the recovery of water and gas from a reservoir and extend the useful life of a well. Flow restriction devices often include one or more valve assemblies, which include without limitation filters, chokes, tortuous paths, or similar means used to control or restrict fluid flow through the flow restriction device. Flow restriction devices known in the art encounter a number of limitations: they may be adapted to only operate within a given range of reservoir conditions, they may erode or fail, and they may become obsolete as the technology in the field continues to advance.

As reservoir conditions and production requirements change over time, flow restriction devices may fail or begin to perform at suboptimal levels. A method to remove, install, replace or plug off flow restriction devices would enable greater control and optimization of fluid flow, resulting in improved reservoir drainage and fluid injection during reservoir exploitation operations. As a result, the need exists for a method to perform such modification.

Aarbakke Innovation AS, Bryne, Norway, is developing one embodiment of a wellbore intervention tool, further described in International Application Publication No. WO 2015/175025, that is capable of performing in-well operations such as machining and milling through wellbore tubulars, e.g., liner or casing. This type of wellbore intervention tool may be adapted to remove an element of a flow restriction device, install a new element on a wellbore tubular, block an opening in the tubular annulus, and perform similar modification operations. Additionally, new wellbore intervention tool technology may see improved operation by means of a radial protrusion extending from the wellbore intervention tool, and may also contain flow restriction devices that may be installed downhole.

SUMMARY

A method for modifying an element disposed at a first location on a wellbore tubular according to one aspect of the disclosure comprises positioning a wellbore intervention tool at the first location. The wellbore intervention tool comprises a housing and a penetration device. The penetration device is operated to remove the element and create an orifice on the wellbore tubular at the first location.

In some embodiments, the wellbore tubular further comprises one or more additional locations each having an element associated therewith, the method further comprising repositioning the wellbore intervention tool at the one or more additional locations and operating the penetration device to remove the element associated therewith and to create one or more orifices at the one or more additional locations.

In some embodiments, the element comprises a flow control device.

In some embodiments, the element comprises a valve.

Some embodiments further comprise operating an installation device on the wellbore intervention tool and installing a replacement element in the orifice.

In some embodiments, the element and the replacement element comprise at least one of a choke, a plug, a filter and a tortuous path.

In some embodiments, the element comprises at least one of a choke, a plug, a filter and a tortuous path.

In some embodiments, the penetration device comprises at least one of a mill and a drill.

A method according to another aspect for modifying an element on a wellbore tubular, wherein the wellbore tubular comprising an internal profile, comprises moving a wellbore intervention tool comprising a housing, a sensor, a radial protrusion and a penetration device along an interior of the wellbore tubular. At least one of the sensor and the radial protrusion is used to detect a first location proximate internal profile and stopping the wellbore intervention tool in the wellbore tubular when the first location is detected. The penetration device is operated to remove the element.

In some embodiments, the sensor comprises an optical imaging device or an acoustic imaging device.

In some embodiments, the sensor comprises a transmitter.

Some embodiments further comprise utilizing the sensor to transmit and receive information with respect to the location of the element.

In some embodiments, the radial protrusion comprises a suction device, the method further comprising utilizing the suction device to identify the location of the element.

In some embodiments, the radial protrusion comprises a flowmeter, the method further comprising utilizing the radial protrusion to determine the orientation of the element.

In some embodiments, the wellbore tubular further comprises one or more additional locations each having an element associated therewith, the method further comprising repositioning the wellbore intervention tool at the one or more additional locations using at least one of the sensor and the radial protrusion and operating the penetration device to remove the element associated therewith and to create one or more orifices at the one or more additional locations.

Some embodiments further comprise operating an installation device on the wellbore intervention tool and installing a replacement element in the orifice.

In some embodiments, the element and the replacement element comprise at least one of a choke, a plug, a filter and a tortuous path.

In some embodiments, the element comprises a flow control device.

In some embodiments, the element comprises a valve.

In some embodiments, the penetration device comprises at least one of a mill and a drill.

Other aspects and advantages will be apparent from the following description and appended claims.

BRIEF DESCRIPTION OF THE DRAWINGS

The accompanying drawings, described below, illustrate example embodiments according to the present disclosure and are not to be considered limiting of the scope of the disclosure, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

Figure 1:
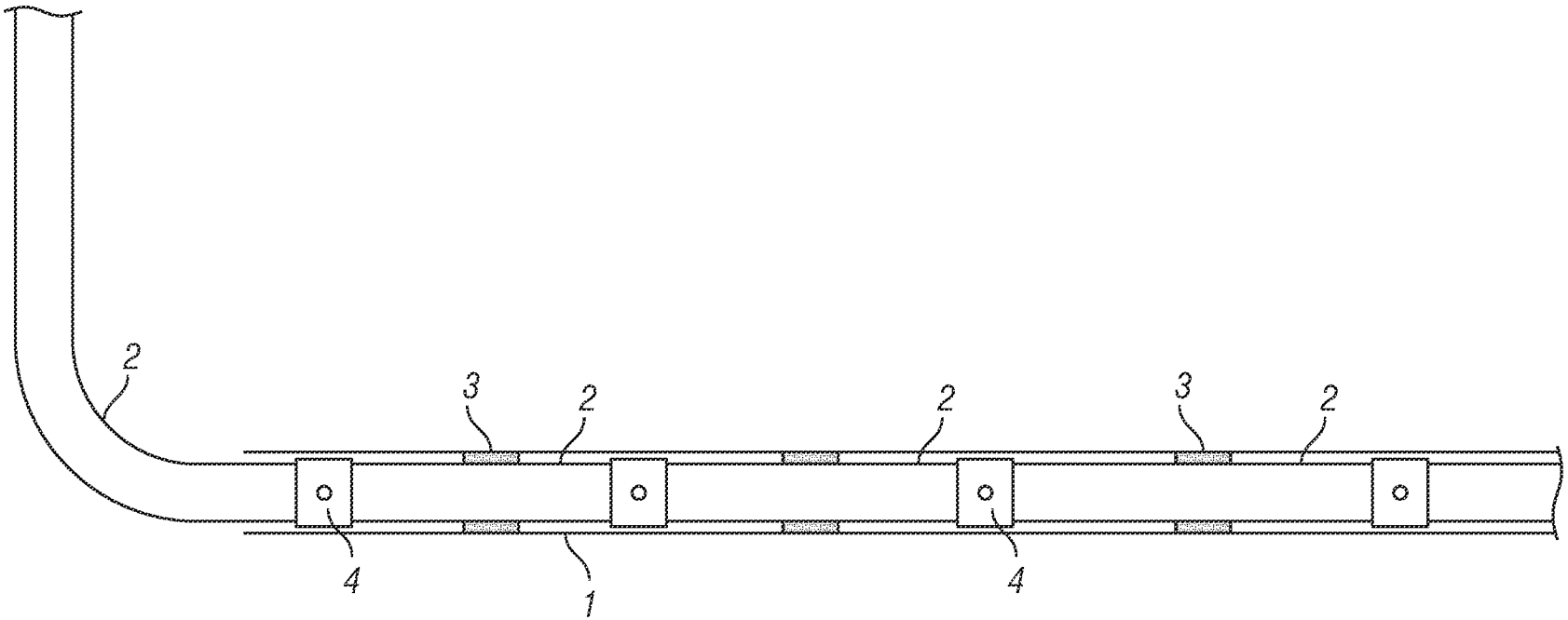
FIG. 1 is a simplified drawing of a wellbore in which flow control devices and zonal isolation devices are located.

FIG. 1 illustrates a wellbore 1 into which one or more wellbore tubulars 2, for example and without limitation wellbore casing, production tubing, liner and similar wellbore conduit (called "tubulars" for convenience) have been inserted ("run"). The wellbore 1 and tubular 2 shown in FIG. 1 are a lateral wellbore extending from a vertical wellbore, however the present disclosure is not limited to such wellbore and tubular configuration. One or more flow control devices 4, such as inflow control devices (ICDs) may be located at longitudinally spaced apart locations along one or more sections of the tubular 2. The one or more flow control devices 4 may be located axially between one or more isolation devices 3, which may be zonal isolation devices, mechanical packers, hydraulic packers, inflatable packers or swellable packers, along the section of tubular 2. If used, the zonal isolation devices 3 may close an annular space (not shown separately) between the exterior of the tubular, e.g., at 2, and formations through which the wellbore 1 is drilled or an interior of another tubular (not shown) within which the wellbore tubular 2 is nested. Isolation of a section of tubular 2 allows the flow restriction devices 4 to provide compartmentalized and selective transfer of fluids through the annulus of the wellbore 1 and into the interior of the wellbore tubular 2.

Figure 2B:
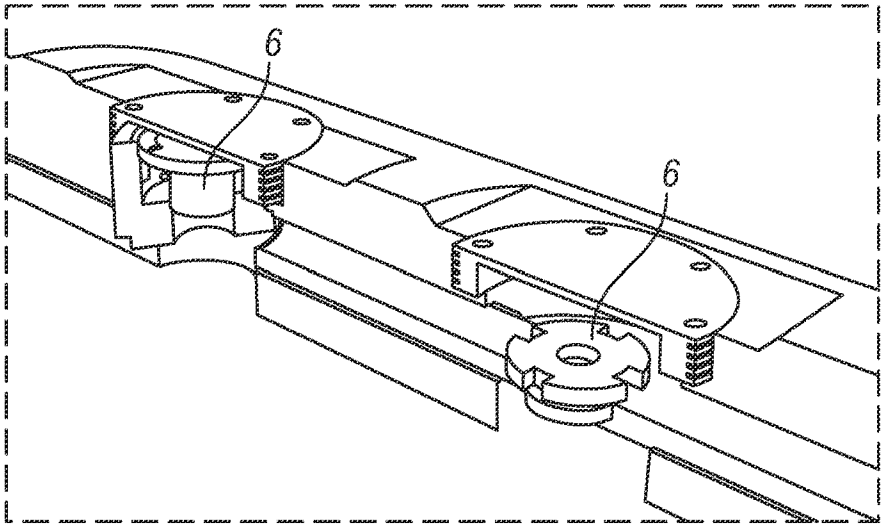
FIG. 2B shows an expanded view of the components of the ICD in the inset in FIG. 2A.
Figure 2A:
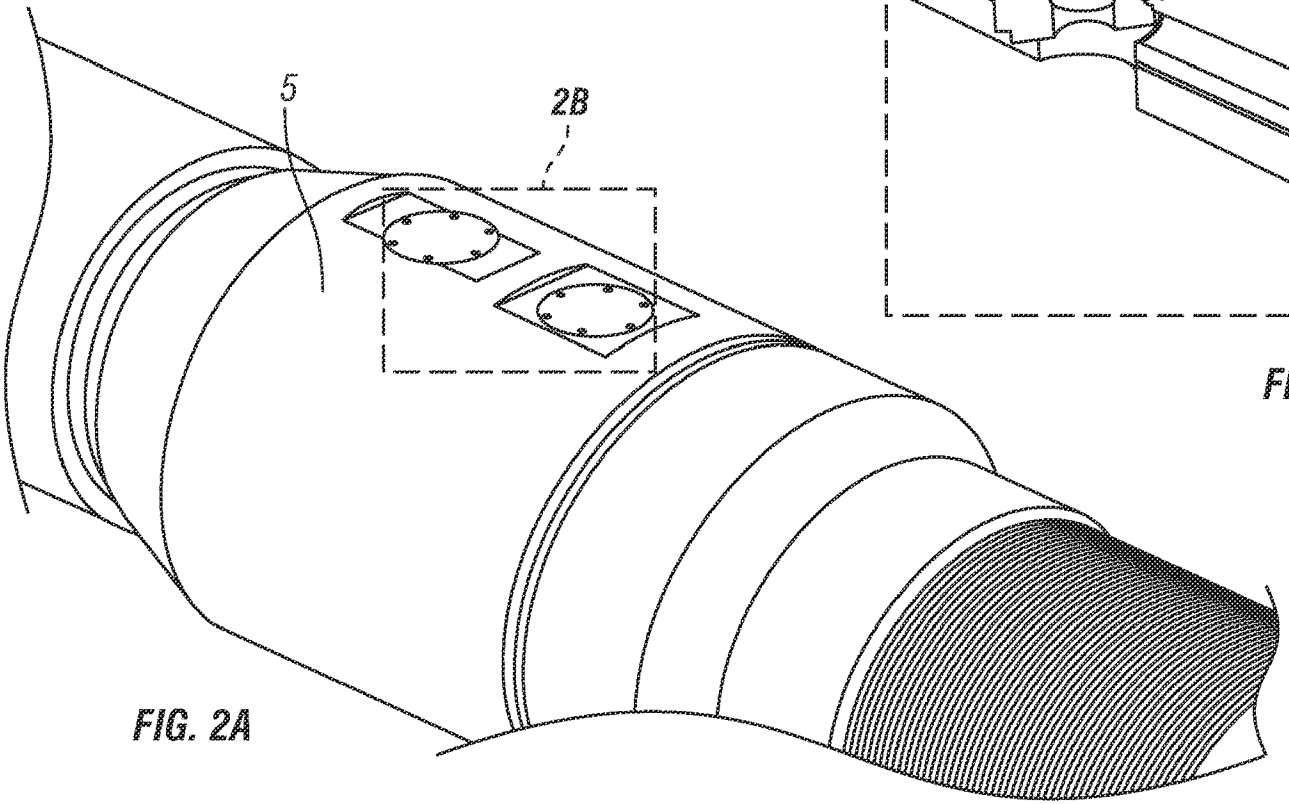
FIG. 2A shows one embodiment of an inflow control device (ICD) containing a valve assembly.

FIG. 2A shows one embodiment of an ICD 5 including, in the inset in FIG. 2B, a valve assembly 6 located within the ICD 5. The valve assembly 6 may allow fluids to pass radially through the ICD 5 according to certain predetermined characteristics, for example, pressure and/or flow rate. During production operations, that is, when the wellbore (1 in FIG. 1) is configured to move fluid from a subsurface reservoir to the Earth's surface, the valve assembly 6 may experience any one or more of a number of failures and inefficiencies well known to those skilled in the art.

Figure 3:
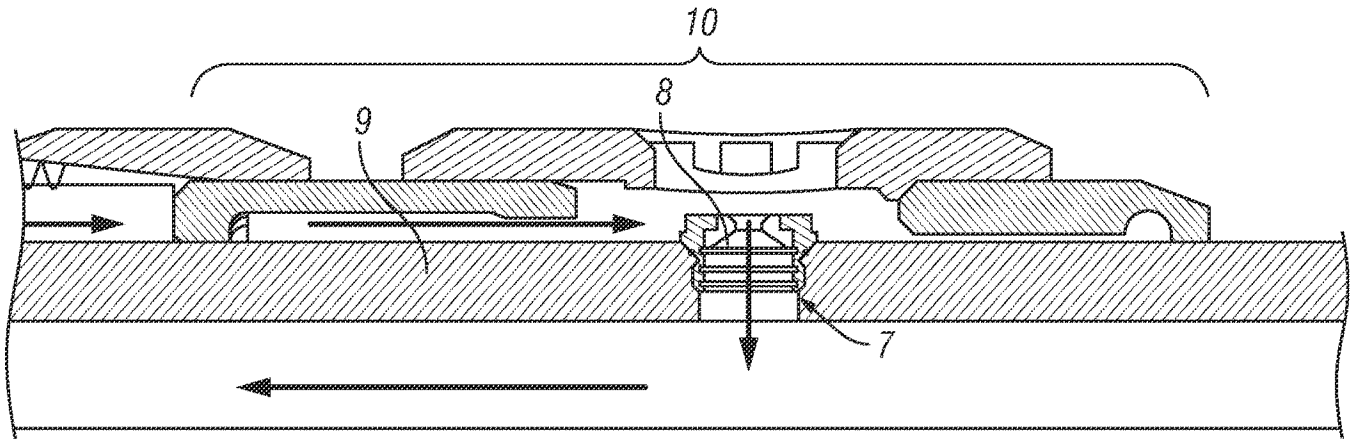
FIG. 3 shows a side view of a second embodiment of an ICD.

FIG. 3 shows another embodiment of an ICD 7 including a valve assembly 8. The valve assembly 8 may be configured to allow fluids to pass through the ICD 7 in only one radial direction. The ICD 7 may be fixedly located proximate the wall of a wellbore tubular 9. The ICD 7 may include a protective assembly 10 to protect the valve assembly 8 on its exterior from exposure to undesirable materials and substances that may be located in a wellbore annulus, that is, the space between an exterior of the wellbore tubular and the wellbore (1 in FIG. 1) or another tubular (not shown) disposed externally to the wellbore tubular 9.

Figure 4:
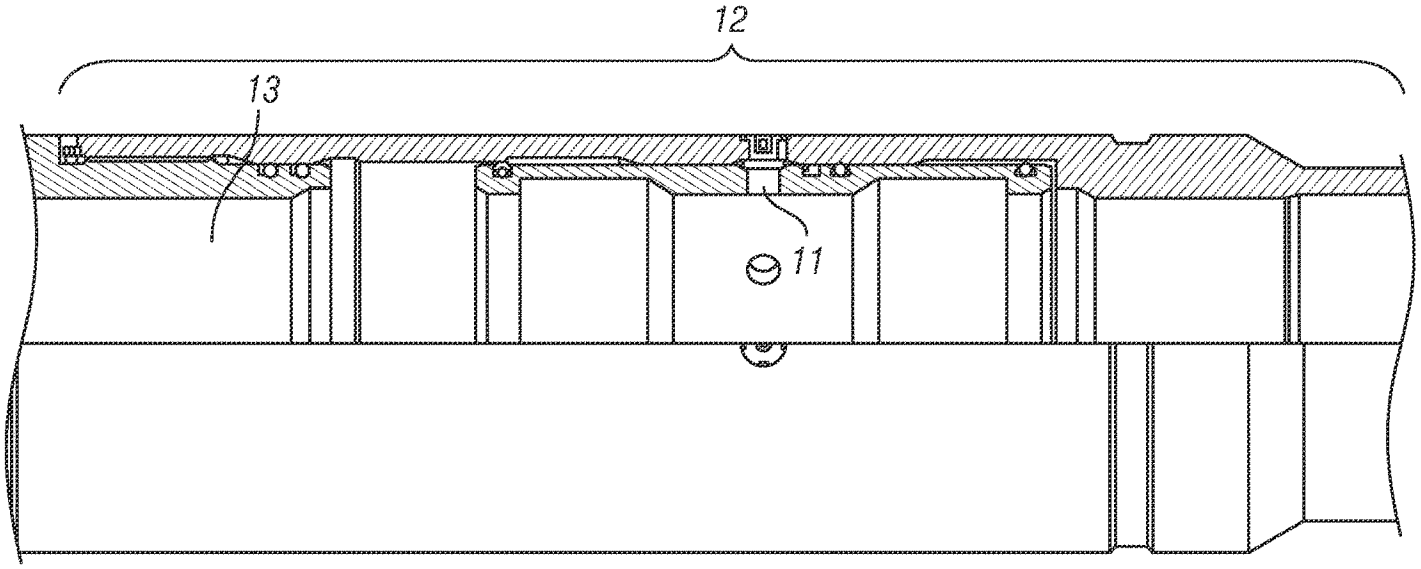
FIG. 4 shows a cutaway side view of a flow control device located in a wellbore.

FIG. 4 illustrates another embodiment of a flow control device 11 located on a completion assembly 12, which device 11 may be a sliding sleeve, located radially outward of a section of wellbore tubular 13. The flow control device 11 may be exposed directly to a wellbore annulus, e.g., as explained with reference to FIG. 3.

Figure 5:
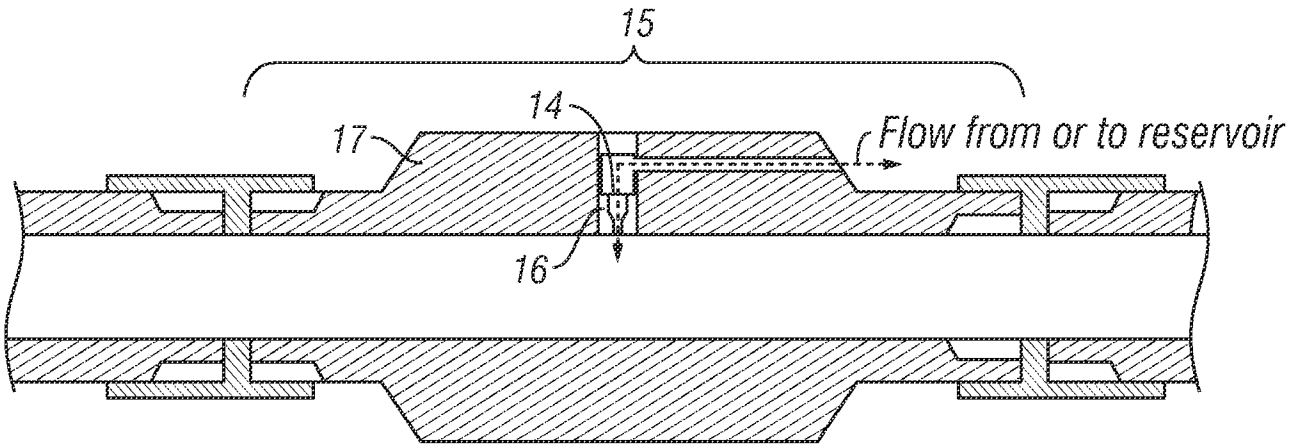
FIG. 5 shows a side view of an embodiment of a flow control device located in a wellbore.

FIG. 5 shows an example embodiment of a flow control device 14 located on a section of wellbore tubular 15. The flow control device 14 may include a valve assembly 16 that may be configured to allow fluids to pass bidirectionally through the flow control device 14. The flow control device 15 may be located on a mandrel 17 adapted to fixedly hold the flow control device 15 in place on the wellbore tubular 15.

Figure 6:
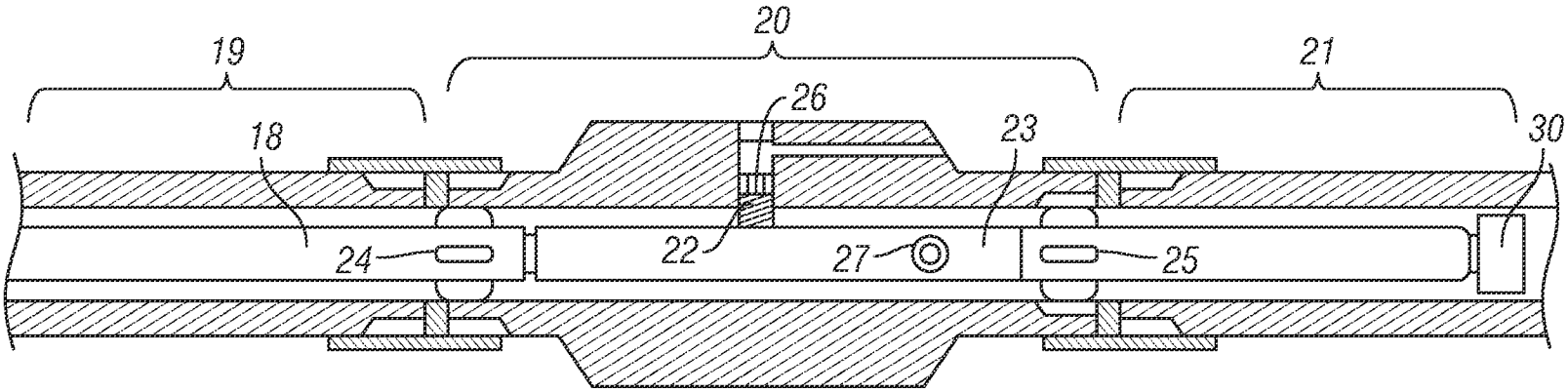
FIG. 6 shows a side view of an embodiment of a wellbore intervention tool, positioned to remove an element of a flow control device within a wellbore.

FIG. 6 illustrates an example embodiment of a wellbore intervention tool 18 located within one or more tubulars 19, 20, 21. The wellbore intervention tool 18 may include a penetration device 22 located on an elongated housing 23 of the wellbore intervention tool 18. In some embodiments, the penetration device 22 may be moved longitudinally and/or radially about the housing 23. The wellbore intervention tool 18 may include one or more retractable and extendable supports 24, 25 which when extended may hold the elongated housing 23 radially and/or longitudinally in place within one of the tubulars 19, 20, 21 once the penetration device 22 reaches a desired location. In some embodiments, the retractable and extendable supports 24, 25 may seal an annulus between the housing 23 and any of the tubulars 19, 20, 21.

The intervention tool operator may position the wellbore intervention tool 18 axially in the wellbore tubular 15 so that the penetration device 22 is located adjacent to a flow control element 26 which may be located on the tubular 20. The wellbore intervention tool may be as further described in International Application Publication No. WO 2015/175025, incorporated herein by reference. In some embodiments, the flow control element 26 may be a valve assembly. In some embodiments, a plurality of the flow control elements 26 may be disposed at one or more locations on the tubular 20 where the intervention tool operator desires to install one or more replacement flow control elements 27. By way of example and without limitation, the one or more replacement flow control elements 27 may be chokes, plugs, filters, tortuous paths, or other well-known devices used to control or restrict fluid flow. In the present example embodiment, the wellbore intervention tool 18 may have the replacement flow control element onboard for eventual disposal into the wellbore tubular 15. Once the wellbore intervention tool 18 has been positioned to locate the penetration device 22 adjacent to the flow control element 26, the penetration device 22 may be urged radially outwardly from the housing 23 by means including, without limitation, mechanical or hydraulic actuation to remove the flow control element 26. In some embodiments, the penetration device 22 may comprise a mill or drill bit to remove the flow control element 26 by milling or drilling. Once the removal operation has been performed, the penetration device 22 may be retracted into the housing 23. In the event the intervention tool operator wishes to remove more than one flow control element 26, the steps of positioning the wellbore intervention tool 18 and performing the removal operation may be repeated at multiple locations along the wellbore tubular 15.

The wellbore intervention tool 18 may include a sensor 30, which may be incorporated into the wellbore intervention tool 18 or may be coupled to the wellbore intervention tool 18. The sensor 30 may, without limitation, be a transmitter, an optical imaging device, a pin and position sensor or an acoustic imaging device, and may comprise a camera or transducer. The sensor 30 may be utilized to facilitate the intervention tool operator's navigation of the wellbore intervention tool 18 to a desired location proximate the flow control element 26. In some embodiments, the sensor 30 may provide optical or acoustic imaging information to detect the location of the flow control element 26. In other embodiments, the sensor 30 may transmit and receive information with respect to the location of the flow control element 26.

Figure 7:
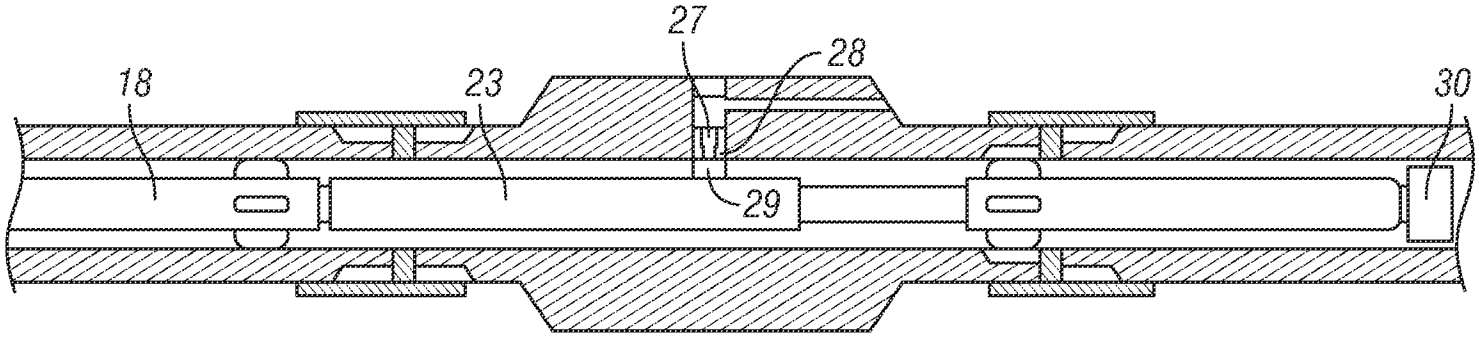
FIG. 7 shows the wellbore intervention tool of FIG. 6, positioned to insert a new element.

FIG. 7 shows the wellbore intervention tool 18 of FIG. 6. As shown, the intervention tool operator may position the housing 23 of the wellbore intervention tool 18 to locate an orifice 28. In some embodiments, the wellbore intervention tool 18 may create the orifice 28 by removing the flow control element 26 of FIG. 6. In other embodiments, the orifice 28 may be a section of a flow restriction device. The wellbore intervention tool 18 may include an installation device 29, which may extend radially from the wellbore intervention tool 18. Once the wellbore intervention tool 18 has been positioned to locate the orifice 28, the intervention tool operator may install the replacement flow control element 27 within the orifice 28. Installation of the replacement flow control element 27 may be performed by screwing, pushing, locking, adhesion or similar operations. In the event the intervention tool operator wishes to install more than one replacement flow control element 27, he may reposition the wellbore intervention tool 18 and repeat the installation operation of the one or more replacement flow control elements 27 at multiple locations along the wellbore.

Figure 8:
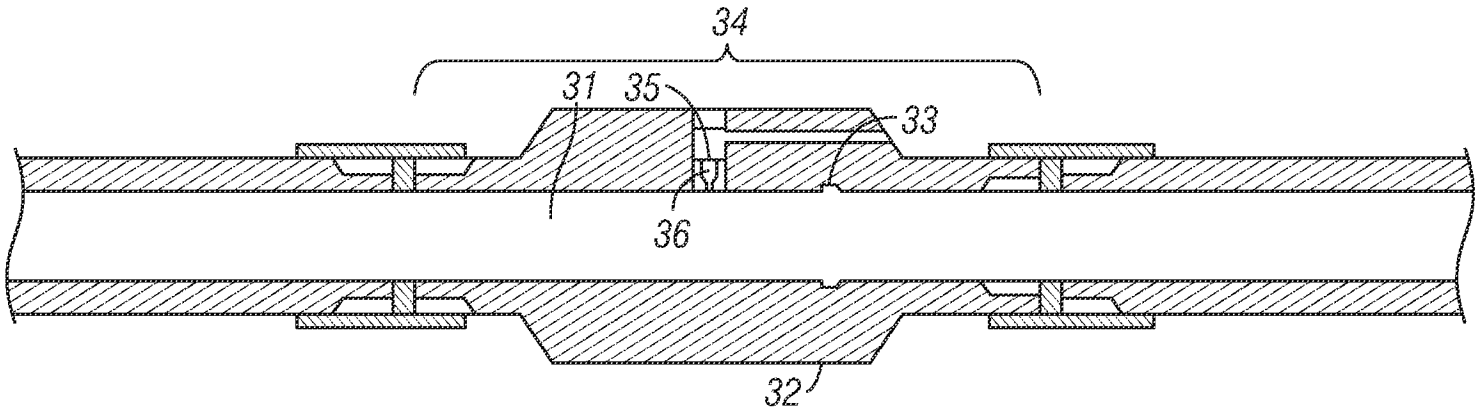
FIG. 8 shows a side view of another embodiment of a wellbore intervention tool adapted to locate an element of a flow control device.

FIG. 8 shows another example embodiment of a wellbore intervention tool 31 including a radial protrusion 32 part of the wellbore intervention tool 31. The radial protrusion 32 may be adapted to substantially coincide with an internal receptacle 33 which, without limitation, may be located on a wellbore tubular 34, a flow control device 35, or a flow control element 36. The flow control element 36 may, by way of example and without limitation, be a valve assembly. The receptacle 33 provides a positive mechanical means, e.g., known as a "profile", to engage the radial protrusion 32 so as to locate the intervention tool 31 suitably to service the flow control element 36. The intervention tool operator may use the radial protrusion 32 to identify a desired location of the wellbore intervention tool 31 proximate the flow control element 36 to be removed or replaced. In some embodiments, the radial protrusion 32 may facilitate the replacement of the element 36 by extending into the receptacle 32. In some embodiments, the radial protrusion 32 may contain a flowmeter capable of detecting fluid flow through the flow control element 36 and/or allow the operator to determine the orientation of the flow control element 36 circumferentially about the tubular 34. In some embodiments, the radial protrusion 32 may be a rotating suction device operated by a pump located within the wellbore intervention tool 31, which suction device may rotate to identify the circumferential and longitudinal location of the flow control element 36.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A method for modifying a flow control device disposed at a first location on a wellbore tubular, the flow control device operable to affect fluid flow from outside the wellbore tubular to an interior of the wellbore tubular, comprising:

positioning a wellbore intervention tool at the first location, the wellbore intervention tool comprising a housing a penetration device and an installation device, the penetration device comprising a mill or drill;

operating the mill or drill to remove the flow control device and create an orifice on the wellbore tubular at the first location; and operating the installation device and installing a replacement element flow control device in the orifice.

2. The method of claim 1, wherein the wellbore tubular further comprises one or more additional locations each having a flow control device associated therewith, the method further comprising repositioning the wellbore intervention tool at the one or more additional locations and operating the penetration device to remove the flow control device associated therewith and to create one or more orifices at the one or more additional locations.

3. The method of claim 1 wherein the flow control device and the replacement flow control device comprise at least one of a choke, a plug, a filter and a tortuous path.

4. The method of claim 1 wherein the flow control device comprises at least one of a choke, a plug, a filter and a tortuous path.

5. A method for modifying an element on a wellbore tubular, the wellbore tubular comprising an internal profile, comprising:

moving a wellbore intervention tool comprising a housing, a sensor comprising a flowmeter, a radial protrusion comprising a suction device, and a penetration device along an interior of the wellbore tubular, the penetration device comprising a mill or drill;

utilizing at least one of the sensor and the radial protrusion to detect a first location proximate internal profile and stopping the wellbore intervention tool in the wellbore tubular when the first location is detected; and operating the mill or drill to remove the element.

6. The method of claim 5, wherein the sensor further comprises an optical imaging device or an acoustic imaging device.

7. The method of claim 5, wherein the sensor comprises a transmitter.

8. The method of claim 5, further comprising utilizing the sensor to transmit and receive information with respect to the location of the element.

9. The method of claim 5, further comprising utilizing the radial protrusion to determine the orientation of the element.

10. The method of claim 5, wherein the wellbore tubular further comprises one or more additional locations each having an element associated therewith, the method further comprising repositioning the wellbore intervention tool at the one or more additional locations using at least one of the sensor and the radial protrusion and operating the penetration device to remove the element associated therewith and to create one or more orifices at the one or more additional locations.

11. The method of claim 5, further comprising operating an installation device on the wellbore intervention tool and installing a replacement element in the orifice.

12. The method of claim 11 wherein the element and the replacement element comprise at least one of a choke, a plug, a filter and a tortuous path.

13. The method of claim 5 wherein the element comprises a flow control device.

14. The method of claim 5, wherein the element comprises a valve.

15. The method of claim 1 wherein the wellbore tubular comprises an internal profile, the flow control device located proximate the internal profile, the method further comprising:

operating at least one of a sensor and a radial protrusion on the wellbore intervention tool to detect the first location; and operating the mill or drill to remove the flow control device.

16. The method of claim 15 wherein the wellbore tubular further comprises one or more additional locations each having a flow control device associated therewith, the method further comprising repositioning the wellbore intervention tool at the one or more additional locations using at least one of the sensor and the radial protrusion, and operating the mill or drill to remove the element associated therewith and to create one or more orifices at the one or more additional locations.

17. The method of claim 16 further comprising operating the installation device at each additional location and installing a replacement element in the orifice made at each additional location.

* * * * *